United States Patent [19]

Van Der Schaaf

[11] 4,140,128

[45] Feb. 20, 1979

[54] SUN TANNING TABLE

[76] Inventor: Joe Van Der Schaaf, c/o General Delivery, Belle Plaine, Minn. 56011

[21] Appl. No.: 815,476

[22] Filed: Jul. 14, 1977

[51] Int. Cl.[2] ..... A47B 11/00

[52] U.S. Cl. ..... 128/376; 272/144; 108/150; 108/20

[58] Field of Search ..... 108/20, 21, 22, 150, 108/94, 139; 5/60, 2, 344; 272/144; 211/1.5; 128/376, 362, 372, 373

[56] References Cited

U.S. PATENT DOCUMENTS

| | | | |
|---|---|---|---|
| 115,948 | 6/1871 | Ford | 5/60 |
| 472,911 | 4/1892 | Sinclair | 108/161 |
| 793,168 | 6/1905 | Abrams | 5/60 X |
| 1,176,270 | 3/1916 | Bookstaber | 108/20 |
| 2,560,659 | 7/1951 | Payeur | 108/139 |
| 2,764,412 | 9/1956 | Dunham | 272/144 |
| 2,849,729 | 9/1958 | Goodey, Jr. et al. | 5/2 |
| 3,002,628 | 10/1961 | Reddell | 211/1.5 |
| 3,646,896 | 3/1972 | Derujinsky | 5/344 |

FOREIGN PATENT DOCUMENTS

| | | | |
|---|---|---|---|
| 223967 | 8/1959 | Australia | 108/139 |
| 679176 | 7/1939 | Fed. Rep. of Germany | 108/20 |
| 734523 | 5/1943 | Fed. Rep. of Germany | 150/ |
| 484563 | 9/1953 | Italy | 5/60 |
| 199645 | 6/1923 | United Kingdom | 108/150 |

*Primary Examiner*—Roy D. Frazier
*Assistant Examiner*—P. A. Aschenbrenner
*Attorney, Agent, or Firm*—Bernard L. Kleinke

[57] ABSTRACT

A sun tanning table adapted to support the body of the user for sun tanning purposes, including a base adapted to be supported on the ground, and a substantially flat table top mounted on the base for supporting the body of the user in a reclining position for sun tanning purposes. A device is provided for mounting rotatably the table top on the base to enable the table top to rotate continuously through 360 degrees relative to the base. A motor rotates the table top about its vertical axis relative to the base to enable the user to attain a uniform sun tan.

6 Claims, 3 Drawing Figures

SUN TANNING TABLE

The present invention relates in general to a sun tanning table, and more particularly relates to a table adapted to support a user in a reclining position to facilitate attaining a uniform sun tan.

For those persons who are desirous of obtaining a sun tan, it is well known that it is only necessary for one to recline or otherwise repose in direct sun light so that the ultraviolet rays tan the skin. However, it is also well known that if a person remains in the same position relative to the sun, for sufficiently long periods of time, the skin can be subjected to a sun burn.

Therefore, it would be highly desirable to have a table which would move the sun bather so as to achieve a uniform sun tan and to avoid sun burns. Some different types of tables which may have some relevance to the type of table desired may be found in the following U.S. Pat. Nos. 2,494,242; 2,877,827 and 3,626,871. However, none of these tables disclosed in the foregoing-mentioned patents would be suitable for use as a sun tanning table.

Therefore, the principal object of the present invention is to provide a new and improve sun tanning apparatus, which enables the user to acquire a uniform sun tan, and which is relatively inexpensive to manufacture and convenient to use.

Briefly, the above and further objects of the present invention are realized by providing a sun tan table, which has a table top rotatably mounted on a base, and a motor for driving the table top about a vertical axis so that the user can recline on the upper surface of the table top as the table top revolves slowly, whereby the user can then acquire a uniform sun tan and minimize the possibility of sun burn or other damage to the skin. The table top is in the form of an open frame covered with criss-crossing flexible webbing strips. The motor is concealed in the inverted dish-shaped base. A drinking glass holder is mounted on the table top and enables the user to have a place for drinking glasses while reclining in the sun.

These and other important objects and advantages of the invention will be more fully understood upon a reading of the following specification taken in view of the attached drawings, wherein.

Figure 1:
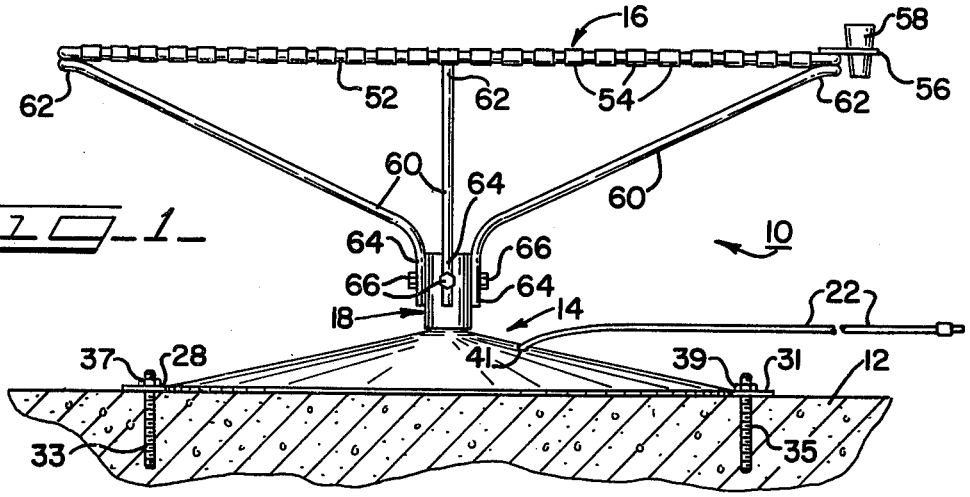
FIG. 1 is an elevational view of a sun tan table, which is constructed in accordance with the present invention.
Figure 2:
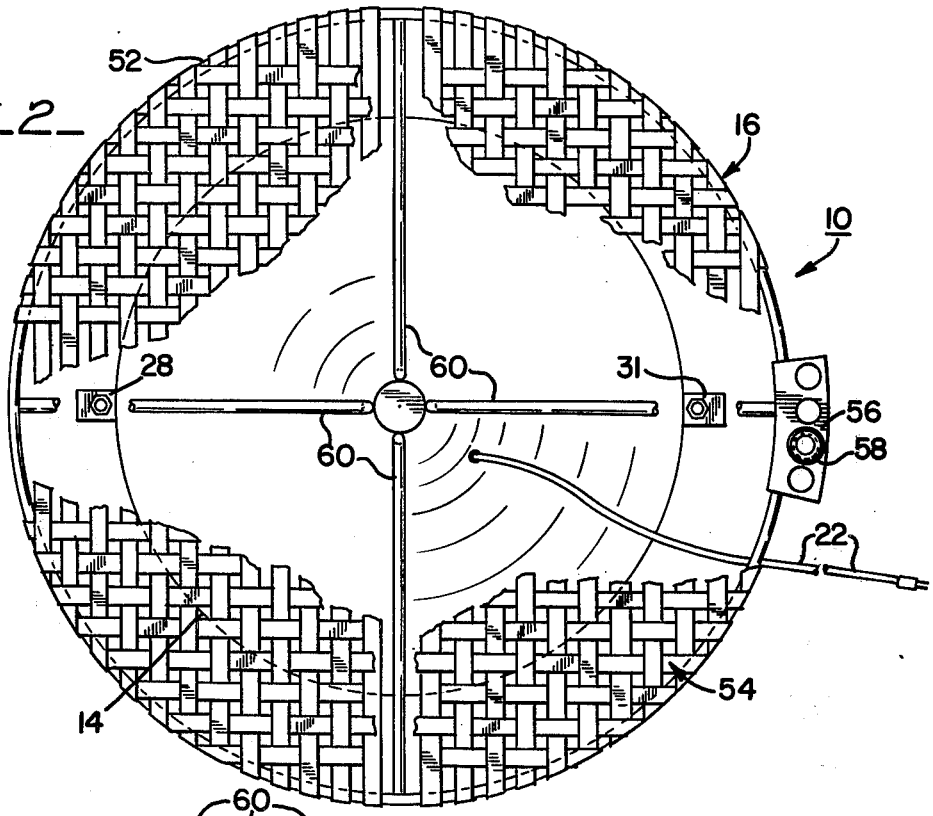
FIG. 2 is a plan view of the sun tan table of FIG. 1.
Figure 3:
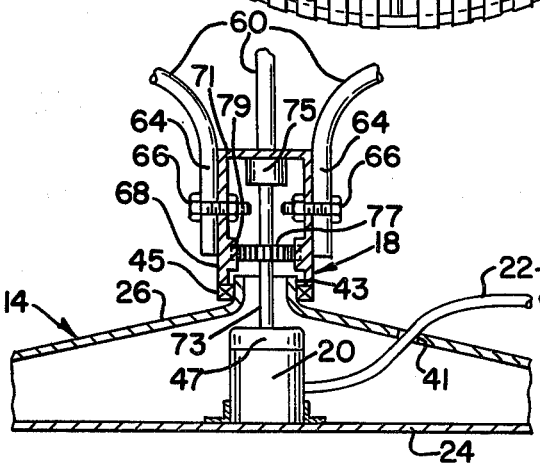
FIG. 3 is an enlarged fragmentary cross-sectional view of the bottom portion of the sun tan table of FIG. 1.

Referring now to the drawings, and more particularly to FIGS. 1 and 2 thereof, there is shown a sun tan table 10, which is constructed in accordance with the present invention and which is fixed to a concrete slab 12, such as a patio or other convenient supporting surface. The sun tan table 10 generally comprises a base 14 supported on top of the concrete slab 12 for supporting a circular table top 16 which is adapted to support a user reclining in a horizontal disposition on top thereof for receiving a sun tan. A rotatable connection 18 rotatably mounts the table top 16 in axial alignment with the base 14. As best seen in FIG. 3 of the drawings, a motor 20 is mounted within the base 14 for driving the table top 16 about its vertical central axis in a slow manner so that the user resting thereon can receive a uniform sun tan.

A power cord 22 supplies electrical energy to the motor 20 for operating it.

In use, the person desiring to acquire a sun tan, rests in a reclining position on top of the table top 16, and then turns on the motor 20. The motor 20 then causes the table top 16 to rotate about its vertical central axis in a slow manner, such as about one revolution every ten minutes, whereby the user can acquire a uniform sun tan while minimizing a risk of sun burn or other damage to the skin from the sun. The table top 16 continues to rotate in the slow manner, while providing a comfortable support for the user as hereinafter described in greater detail.

Considering now the base 14 in greater detail with reference to FIGS. 1 and 3 of the drawings, the base 14 includes a flat bottom wall 24 resting on the upper surface of the concrete slab 12. A dish-shaped upper wall 26 opens downwardly and is connected to the bottom wall 24.

The base 14 is circular in shape and is substantially the same diameter as the diameter of the table top 16. A pair of apertured tabs or flanges 28 and 31 are disposed at diametrically opposed positions on the base 14 for receiving a pair of upstanding threaded rods 33 and 35 extending from the concrete slab 12 and fastened in place with nuts 37 and 39 respectively to secure the base 14 to the slab 12. As a result, the table top 16 rotates about its central vertical axis relative to the fixed base 14.

A power cord opening 41 in the upper wall 26 receives the power cord 22 which has one of its ends connected electrically to the motor 20 which rests on the bottom wall 24, the other end of the power cord 22 being disposed externally of the base 14 so that it can be connected to a source of electrical energy.

A centrally disposed collar or neck portion 43 of the upper wall 26 has a thrust bearing 45 surrounding it for supporting rotatably the connection 18.

A gear box 47 for the motor 20 serves as a speed reducer so that the table top 16 can be rotated at a very slow rate.

Considering now the table top 16 in greater detail with particular reference to FIGS. 1 and 2 of the drawings, the table top 16 includes a circular frame 52 which has stretched thereover a plurality of criss-crossed flexible webbing strips 54. The flexible webbing strips 54 are composed of suitable flexible plastic material, which resists damage from the weather. The criss-cross pattern of the flexible webbing strips is in the form of an interweaving of the strips so that air can readily circulate therethrough for ventilation purposes, whereby the comfort and convenience of the user is facilitated. Moreover, the open criss-cross pattern of the webbing strips facilitates drainage when the table 10 is left out of doors during non-use. The criss-cross flexible webbing strips 54 are disposed in a horizontal plane so that the user can recline on the top surface thereof in a comfortable and convenient manner. In this regard, the webbing strips 54 conform slightly to the contours of the body of the user when reclining thereon to provide a comfortable and convenient manner of resting in the sunshine while obtaining a uniform sun tan.

By employing the criss-cross flexible webbing strips 54, there is no need for the addition of mattresses or other cushions, unless the user desires to employ a pillow.

A drinking glass holder in the form of an apertured plate 56 is fixed to the circular frame 52 for supporting in a convenient manner a plurality of drinking glasses or cups, such as the drinking glass 58 so that as the table top 16 rotates about its vertical central axis to carry the user therewith, the drinking glass holder is carried by and rotates with the circular frame 52. As a result, the user can conveniently make use of the drinking glasses while acquiring a sun tan.

A series of struts or ribs 60 have their upper ends 62 fixed to the circular frame 52 at equally spaced-apart positions therealong. The upper ends 62 of the struts or ribs 60 are each rigidly connected to the circular frame 52 by any convenient technique, such as by welding and then grinding off the welds. The lower apertured ends 64 of the struts or ribs 60 are fixed to the rotatable connection 18 by means of a series of nuts and bolts 66.

Considering now the rotatable connection 18 in greater detail with reference to the drawings, and more particularly to FIG. 3 thereof, the rotatable connection 18 includes a cylindrical member 68 having a closed upper end wall 71. The opposite end of the cylindrical member 68 is open, and an output shaft 73 from the gear box 47 extends through the open lower end of the cylindrical member 68 and into the interior therein. The upper end of the shaft 73 is journaled for rotation at 75 at the closed upper end wall 71.

A gear 77 is fixed to the shaft 73 within the interior of the cylindrical member 68 and meshes with an internal gear 79 to drive the cylindrical member 68 and thus cause it to rotate about its central vertical axis.

Therefore, in operation, once the motor 20 is energized, the shaft 73 rotates relative to the base 14 to in turn rotate the gear 77. As the gear 77 rotates about a vertical axis which is common to the vertical axis of the cylindrical member 68 and the table top 16, the cylindrical member 68 having the internal gear 79 rotates about its central vertical axis. As a results, the table top 16 in turn rotates about its central vertical axis to carry the user resting on the top surface thereof.

In the preferred form of the present invention, the table top 16 rotates relative to its base 14 at the rate of approximately one revolution every ten minutes. As a result, the user is able to receive a uniform sun tan.

It should be understood by those skilled in the art, that the sun tan table 10 may also be a portable unit energized by a battery (not shown). In this manner, the sun tan table 10 can be taken to remote locations such as beach areas and operated from its own self contained source of energy such as a battery. In this manner, there is no need to bolt the base 14 to the ground. The battery can be disposed within the hollow interior of the base 14 on top of the bottom floor or wall 24 so that the weight of the battery can serve to retain the base 14 in position.

Due to the rotatable connection 18, the entire sun tan table 10 can be placed on its side with its vertical axis being rotated through 90 degrees and rolled along the ground for transporting the table 10 when it is of a large size. For example, the table top 16 is preferably about seven feet in diameter.

It will be readily apparent to those skilled in the art that the present invention provides a novel and useful improvement in sun tanning apparatus. The arrangement and types of structural components utilized within the invention may be subject to numerous modifications well within the purview of this invention and it is intended only to be limited to a liberal interpretation of the specification and appended claims.

What is claimed is:

1. A sun tanning table adapted to support the body of the user for sun tanning purposes, comprising:

a base adapted to be supported on the ground;

a substantially flat table top for supporting the body of the user in a reclining position for sun tanning purposes, said table top including open frame and a group of criss-crossed thin flexible webbing strips extending thereacross in a taut manner to serve as a support for the user, said frame being substantially circular in shape;

bearing means for mounting rotatably said table top on said base to enable said table top to rotate continuously through 360 degrees relative to said base;

motor means for rotating said table top about its vertical axis relative to its base;

said flat table top is substantially the same size as said base so that said table can be turned on its side and rolled along the ground on its table top and its base;

said table top is composed of a tubular substantially circular open frame, said strips extending tightly thereacross in an interwoven manner to provide a supporting surface for the user, said top having a plurality of struts fixedly interconnected to said bearing means; and said bearing means includes a cylindrical member having an internal gear mounted therein, a spur gear driven by said motor means for driving in turn said internal gear.

2. A sun tanning table according to claim 1, further including means carried by said table top for supporting at least one drinking glass.

3. A method of using the rotatable table of claim 1 for enabling a person to acquire a uniform sun tan, comprising:

providing a table having a table top rotatably mounted on a base for supporting the user in a reclining position on an upper surface thereof;

slowly rotating said table top relative to its base about its vertical axis with the user reclining thereon; and continuing to so rotate the table top through 360 degrees.

4. A method according to claim 3, wherein the table top is motor driven.

5. A sun tanning table adapted to support the body of the user for sun tanning purposes, comprising:

a base adapted to be supported on the ground;

a substantially flat table top for supporting the body of the user in a reclining position for sun tanning purposes, said table top including open frame and a group of criss-crossed thin flexible webbing strips extending thereacross in a taut manner to serve as a support for the user;

bearing means for mounting rotatably said table top on said base to enable said table top to rotate continuously through 360 degrees relative to said base;

motor means for rotating said table top about its vertical axis relative to its base;

said bearing means including a cylindrical member having an internal gear mounted therein, a spur gear driven by said motor means for driving in turn said internal gear; and said motor means being mounted in said base, said motor means including a gear box and an output shaft, said spur gear being fixed to said output shaft, said shaft being journaled for rotation within said bearing means.

6. A sun tanning table according to claim 5, wherein said bearing means includes thrust bearing disposed between said cylindrical member and said base.

* * * * *